United States Patent [19]

Gaillard

[11] 4,189,048

[45] Feb. 19, 1980

[54] ARTICLE HOLDER

[76] Inventor: Raymond Gaillard, 183 Lindbergh St., Massapequa Park, N.Y. 11762

[21] Appl. No.: 880,207

[22] Filed: Feb. 22, 1978

[51] Int. Cl.[2] ..... B43K 25/00; A45C 11/00

[52] U.S. Cl. ..... 206/37; 206/38; 206/372; 24/10 R

[58] Field of Search ..... 206/37, 38, 214, 224, 206/234, 306, 371, 372, 373, 817; 24/10 R; 2/249, 250

[56] References Cited

U.S. PATENT DOCUMENTS

| | | | |
|---|---|---|---|
| 2,332,861 | 10/1943 | Langsner | 206/371 |
| 2,412,938 | 12/1946 | Amoth | 206/371 |
| 2,654,130 | 10/1953 | Lundberg | 24/10 R |
| 2,697,258 | 12/1954 | Uyal | 24/10 R |
| 2,812,563 | 11/1957 | Barber | 24/10 R |
| 2,850,152 | 9/1958 | Marrufo | 206/234 |
| 3,056,180 | 10/1962 | Gink | 24/10 R |
| 3,619,817 | 11/1971 | Rockwell | 24/11 CT |
| 3,738,479 | 6/1973 | Sato | 206/306 |

FOREIGN PATENT DOCUMENTS

| | | | |
|---|---|---|---|
| 105503 | 2/1927 | Austria | 206/371 |

*Primary Examiner*—Herbert F. Ross
*Attorney, Agent, or Firm*—Lewis H. Eslinger

[57] ABSTRACT

An article holder adapted to hold pens, pencils or other articles, such as for example hand tools, is formed as a rigid receptacle having a pair of opposed side walls and at least one open end. A spring arrangement is positioned within the receptacle adjacent one open end for biasing articles placed in the receptacle through its open end towards one of the side walls, while also serving to resist transverse movement of the article with respect to the spring thereby to hold the article in a relatively fixed position in the receptacle, without disturbing the remainder of the spring so that the remainder of the spring is available for holding other articles placed in the receptacle. In addition, a stop ledge arrangement is provided in the receptacle adjacent its lower end to limit the depth of insertion of articles into the receptacle and to aid in holding the articles in a relatively fixed position therein. The receptacle is adapted to be removably or permanently secured to a support element, by a clip or other type of mounting arrangement.

30 Claims, 20 Drawing Figures

ARTICLE HOLDER

The present invention relates to an article holder, and in particular to a holder or receptacle adapted to hold pencils, pens, and other articles in briefcases, bags, or garment pockets.

Many people often carry with them a number of different articles, such as writing implements, small tools, rulers, and other articles so that they may be available for use at the different locations to which the person may go. However, problems arise with the transport of such articles in that they are generally loosely held in the pocket, briefcase and the like, so that they are lost or damaged. While some attempts have been made to solve this problem by providing discrete pockets for individual articles in briefcases and the like, so that they cannot fall out of the pockets, such arrangements are relatively expensive and impractical. There is therefore a need for an article holder which can contain or hold a variety of different sized articles, such as pens and pencils, or small tools, without making special provision for any particular sized article, so that no article has a predetermined or preassigned location for placement in the holder. Such an arrangement will require a minimum of visual monitoring to be used in inserting or removing articles from the holder.

A number of different types of article holders, and particular pencil holders, have been proposed in the past which are formed in a variety of constructions. For example, U.S. Pat. No. 1,819,225 to Burman discloses a pocket pencil holder which uses a brush arrangement for holding a pencil in a receptacle. However, it is apparent that the spaced brush arrangement will not accommodate pencils of a variety of different sizes. U.S. Pat. No. 1,364,210, on the other hand, discloses a clip member using individual pairs of spring fingers for holding a pencil in position in a pocket. This arrangement requires the pencil to be placed in the pocket point up, which presents an entirely undesirable arrangement. U.S. Pat. Nos. 2,697,258 and 3,056,108 disclose pocket inserts which use serrated teeth elements to define spaces in which an individual pencil or the like may be placed. Thus, the article used with these holders must be accurately positioned in a serration in order for the device to operate satisfactorily. This is undesirable in that it requires too much effort in aligning the pencil or article with the serrations in order to be practical as a human convenience. U.S. Pat. No. 1,135,174 discloses a folded metal pencil holder in which a gripping member is positioned adjacent the lower end of the container for wedging a pencil or article in a relatively fixed position. However, that arrangement would not appear to prevent lateral movement of the pencils in the container so that pencils can lie in an angled position interfering with insertion or removal of other pencils therein.

It is an object of the present invention to provide a durable and inexpensive article holder particularly adapted for holding pens, pencils or other articles to be transported on the person, in a briefcase, bag or the like.

Another object of the present invention is to provide an article holder which is adapted to receive a variety of different types and sizes of articles of general use with ease, without the need for preselection of location of the article within the holder and with a minimum of visual monitoring.

Another object of the present invention is to provide an article holder in which articles can be removed with ease while still being able to hold the articles in their inserted position and location without movement, even when subjected to transportation on the person or in a briefcase and the like.

A further object of the invention is to provide an article holder having end walls adapted to receive and maintain in a vertical position clasp equipped items which are too large to fit inside the holder or with a clasp motion too small to fit over partitions in a briefcase.

A further object of the present invention is to provide an article holder adapted to hold pencils and the like which protects the sharpened lead of the pencil during storage.

A further object of the invention is to provide a pen and pencil holder or the like which can be readily removably mounted on a support partition or the like in a briefcase or a garment pocket.

Another object of the present invention is to provide an article holder which is adapted to be manufactured of molded plastic or otherwise processed and yet include all of the features mentioned above.

In accordance with an aspect of the present invention an article holder particularly adapted to hold or contain pens, pencils or the like is provided having a substantially rigid receptacle including a pair of opposed generally parallely extending side walls and a pair of laterally spaced end walls connecting the side walls together in a one-piece integral structure. The receptacle has an upper end and an opposed bottom end, with spring means located in the receptacle on at least one of its side walls below its open upper end. This spring biases articles placed in the receptacle through the open end towards the other of the side walls. The spring is particularly designed to have a greater degree of flexibility in the direction which is parallel to the side walls and transverse to the direction of insertion of the articles than it has in the direction of insertion of the article. By this arrangement the spring holds the article in a relatively fixed position against the other of the side walls and resists unrestrained movement of the article in a transverse direction along the spring. This occurs because, in view of its characteristics, the spring is deflected adjacent the article but the portions thereof laterally of the article are not materially deflected from their unrestrained position. Accordingly, the spring forms a pocket which resists lateral movement of the article. Thus, the remainder of the spring stays available for receiving and holding another article without interfering with articles previously placed in the receptacle.

In addition, the receptacle includes along at least one of its side walls, adjacent its lower end, a stop ledge extending generally parallel to the spring for limiting the depth of insertion of articles into the receptacle. Preferably, a pair of spaced stop ledges are provided on opposite walls of the receptacle, to define a slot that receives the tips of a pencil and protects them from damage during transportation.

Finally, the receptacle of the invention is provided with a clasp or other connecting means which enables the receptacle to be removably secured to a support member, such as an inside pocket of an attache case.

The above, and other objects, features and advantages of this invention will be apparent in the following detailed description of an illustrative embodiment thereof which is to be read in connection with the accompanying drawings, wherein:

FIG. 1 is a front elevational view, with part broken away, illustrating one embodiment of the present invention;

FIG. 2 is a vertical sectional view taken along line 2—2 of FIG. 1 and showing the receptacle mounted on a support member;

FIG. 3 is a top plan view of the receptacle illustrated in FIG. 1, showing an additional article mounted on the receptacle;

FIG. 4 is a sectional view taken along line 4—4 of FIG. 1, but showing several articles positioned within the receptacle;

FIG. 5 is a sectional view similar to FIG. 4 of another embodiment of the present invention;

FIG. 6 is a sectional view similar to FIG. 4 of yet another embodiment of the present invention;

FIG. 7 is a sectional view similar to FIG. 4 of a still further embodiment of the present invention;

FIG. 8 is a sectional view similar to FIG. 4 of another embodiment of the invention;

FIG. 9 is a sectional view similar to FIG. 4 of an embodiment of the invention formed with two receptacle sections of different sizes;

FIG. 10 is a partial plan view similar to FIG. 3, showing another configuration for the end walls of the receptacle;

FIG. 10A is a partial plan view similar to FIG. 10 showing another end wall configuration;

FIG. 11 is a partial side sectional view similar to FIG. 2 of the embodiment of the invention shown in FIG. 5;

FIG. 12 is a partial sectional view similar to FIG. 11 of the embodiment of the invention shown in FIG. 6;

FIG. 13 is a side sectional view similar to FIG. 11 of the embodiment of the invention shown in FIG. 7;

FIG. 14 is a partial side sectional view similar to FIG. 11 of the embodiment of the invention shown in FIG. 8;

FIG. 15 is a partial side sectional view similar to FIG. 2, showing a closure mounted on the open lower end of the receptacle;

FIG. 16 is a partial side sectional view similar to FIG. 2, showing a receptacle holder having an integral spring member formed thereon;

FIG. 17 is a partial cross-sectional view similar to FIG. 2, showing a modified clasp structure, used for securing the receptacle to a support member and illustrating the configuration of the clasp structure before mounting;

FIG. 18 is a partial side sectional view similar to FIG. 17, showing the configuration of the clasp of FIG. 17 after the receptacle is mounted on a support;

FIG. 19 is a plan view similar to FIG. 3, of a further embodiment of the present invention having a slightly curved configuration and using a plurality of clasps to mount the receptacle in a pocket or the like.

Figures 1, 2, 3, 4, 5, 6, 7, 8, 9, 10, 10A, 11, 12, 13, 14, 15, 16, 17, 18, 19:
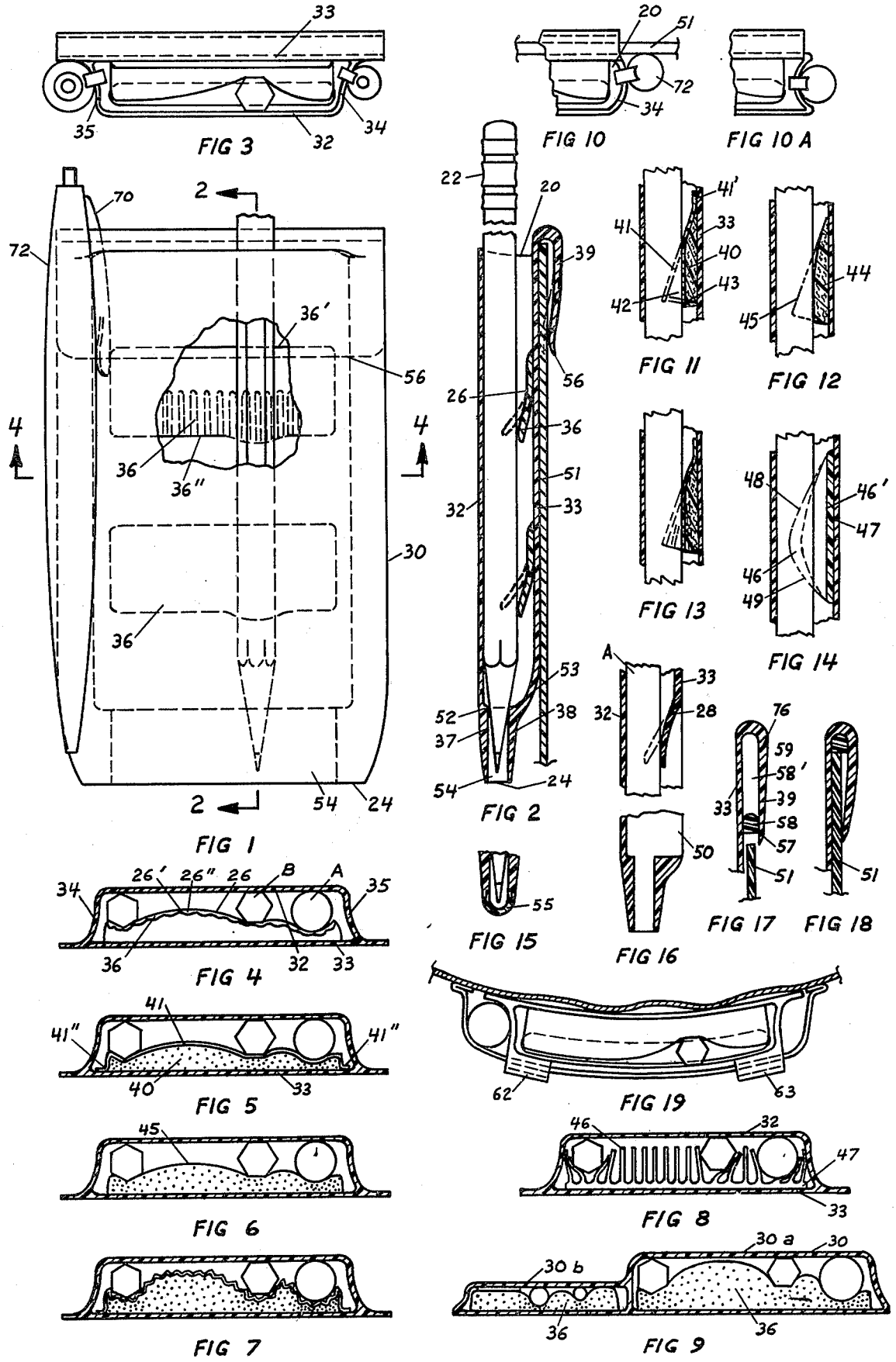

Referring now to the drawings in detail and initially to FIG. 1 thereof, an article holder 30, constructed in accordance with the present invention, is illustrated which is adapted to support individual articles such as for example pens, pencils or small tools, or the like, in a relatively fixed position within the holder. The articles in the holder will not move about therein during transportation under normal conditions, even if the holder is inverted. Preferably, article holder 30 is formed as a plastic receptacle, of polyethylene, polystyrene, or any other convenient relatively rigid plastic material by molding, extrusion molding, or in any other convenient manner. The holder has front and back walls 32, 33 and end walls 34, 35 connecting the side walls in generally parallel relationship which define a receptacle for the articles placed therein. However, it is contemplated that side walls 32, 33 may diverge from one another if desired, as may the end walls. The side and end walls define an open top end 20 in the receptacle through which articles, such as pens or pencils 22, may be inserted. In addition, the receptacle is provided with a bottom wall or skirt at its lower end 24, opposite open end 22. This bottom wall may be open, if desired, as described hereinafter.

The pencils or other articles inserted in receptacle 30 are held in a relatively fixed position against the front wall 32 of the receptacle by one or more spring members 36 located within the receptacle along rear wall 33. In this regard, it is noted that although the preferred embodiments of the present invention are described as having spring elements 36 located along the rear wall in order to hold the pencils against front wall 32, it is contemplated that springs can be provided along the front wall to hold the articles along the rear wall of the receptacle, or even on both the front and rear walls. The spring or springs 36 are especially constructed, as described hereinafter, to hold the articles in a relatively fixed position against lateral movement parallel to the spring within the receptacle so as not to interfere with insertion or withdrawal of other articles into the holder.

The lower end of the receptacle includes a pair of ledges or stop members 37, 38, along front and rear walls 32, 33, which ledges define an opening 54 in the lower end 24 of the article holder. These ledges are slightly spaced from one another to receive therebetween the tip or point of a pencil, or other article, to act as stops limiting the depth of penetration of the article into the receptacle. In addition, where an article such as a pencil or pen is inserted between the ledges, some wedging action will result because of the frictional engagement of the pencil between the ledges, which will also aid in preventing movement of the article in the holder. Alternatively a single ledge or stop member may be used alone on one of the side walls. In addition the edges of the ledges may be serrated to increase the frictional engagement of the pencil tips with the ledge to aid in restraining lateral movement of the pencils.

Finally, the article holder of the invention includes means for securing the holder to a support member, such as for example a shirt pocket or a pocket or separation panel in a briefcase or the like. In the illustrative embodiment of the invention this securing means comprises a clasp 39 which constitutes an integral curved finger or bar formed along the upper edge of the rear wall 33 of the holder, providing a spring force for clasping a support member 51 or the like.

As mentioned above, the springs used in the present invention are designed to insure that the articles are held in a relatively fixed position against lateral movement or inadvertent withdrawal from the holder. In one embodiment of the invention this is accomplished by providing a spring member which constitutes a cantilevered blade 36, having an upper end 36' and a lower end 36". Upper end 36' is adhered or bonded to rear wall 33 of the article holder in any convenient manner, such as for example by an epoxy adhesive or the like. The blade is formed of a resilient plastic material or the like, and has a form such that its lower end projects or cantilevers away from rear wall 33, as illustrated in FIG. 2. This projecting or cantilevered lower portion of the blade is provided with a smooth outer surface 26 and a variable thickness, as seen in FIG. 4. The variable thickness is such that the thin portions 26' of the blade, between the thicker portions 26'' thereof, extend generally vertically, i.e. in the direction of insertion of the pencil into the holder. By this arrangement the blade will be somewhat more flexible (i.e. have somewhat less shear strength) in a transverse direction, i.e., parallel to the plane of the blade and transverse to the direction of insertion of the article, than it is in the direction of application of the spring force holding the article against the front wall 32. Thus, when an article is inserted it will be held against the front wall 32 of the holder and the portions of the blade immediately in contact with the article will flex rearwardly. However, the portions of the blade or spring laterally adjacent the article will not be materially affected, as illustrated in FIG. 4, so that the remainder of the spring is available to engage and hold another article. With this spring structure articles of different sizes can be placed in the article holder and held in a fixed position, since a large article for example the article A in FIG. 4, does not compress or bend the entire spring, but only bends the portion of the spring immediately adjacent thereto. Thus, the remainder of the spring is available for small articles such as for example, article B. The variance in the character of flexibility of the blade can also be achieved by using a corrugated blade material, as illustrated for example in FIGS. 7 and 13. In this case the corrugations run in the same direction along at least the lower portion of the blade, as do the varying thickness ridges in the embodiment of the invention illustrated in FIGS. 1 and 4. The corrugations in the blade produce the reduced shear strength of the blades in the transverse direction, but they also serve to accommodate more readily articles of varying sizes and the corrugations, when depressed, will flatten out to accommodate the article without actually stretching or stressing adjacent portions of the blade so that the remainder of the blade is substantially unaffected by the presence of the article.

Another structure for achieving essentially the same result as the springs of FIGS. 4 and 7 is illustrated in FIG. 5. In this embodiment, a flat sheet of flexible material 42 is adhered along its upper edge 41' as well as along its side edges 41'' to rear wall 33 of article holder 30. However, in this case the sheet does not produce the desired spring action (it is much thinner than the blade previously described) and a compression block 40 is provided which is formed of a foamed plastic material or the like, adhered to the rear wall between the rear wall and the rear face of sheet 41. This foam material provides a spring action to the sheet member 41 at a relatively soft spring rate. The sheet 41 acts as a film on skin, which either may be loose over the block or may be bonded thereto, which protects the resilient block against abrasion and puncturing from items entering into and removed from the article holder. As seen in FIG. 11, block 40 has a generally triangularly shaped cross section so that its lower end 42 protrudes away from the rear wall 33 of the holder. When articles are inserted in the holder the block deflects, as illustrated in FIG. 5, by compressing immediately behind the article while remaining essentially fully expanded in positions adjacent to the article. This forms a pocket in the block about the inserted article which holds the article or pencil against lateral movement. At the same time the resiliency of the block holds the article against the front wall 32 so that it is tightly retained in the article holder even when the holder is inverted. Although a flat sheet or protective member 41 is shown, it is contemplated that sheet 41 be corrugated to more readily accommodate inserted articles without stressing the sheet. In either case the sheet 41 may be positioned either tightly or loosely over the compression block.

A modification of the embodiment shown in FIG. 5 is illustrated in FIGS. 6 and 12 of the drawing. In this embodiment, a compression block 44 is provided with is also formed of a foam plastic material or the like, but which has an integrally formed smooth outer surface 45, to resist abrasion. This surface can be formed on or secured integrally with the foam block in any conventional manner, e.g. by heat treatment, as would occur to those skilled in the art.

A still further embodiment of the invention is illustrated in FIGS. 8 and 14. In this embodiment, in lieu of a blade or compression block type spring, a plurality of thin closely spaced vertical blades 46 are integrally formed on a base block 47 or the like bonded to the rear wall 33 of the holder. These blades have a generally triangular configuration in side view, as illustrated in FIG. 14, with their long base 46' secured to block 47. The other legs 48, 49 have a generally uniform slope, meeting at a curved apex. The triangular configuration of the blades insures that the blades will deflect laterally, as seen in FIG. 8, to accommodate individual articles placed in the holder. However, the bent blades then provide a biasing force holding the articles against the front wall 32 of the receptacle. At the same time, the thicker base portions of the blades, after the article is inserted in the holder, will resist lateral movement of the article within the holder.

In each of the embodiments described thus far, the spring has been formed as a separate element secured to the rear wall of the holder. However, it is contemplated that a spring or spring elements, for holding an article in place in the receptacle, can be integrally molded with the receptacle walls. Thus, as illustrated in FIG. 16, a blade 28 is integrally molded with rear wall 33 of the receptacle. The blade can be molded with a varying cross sectional dimension, as in the embodiment of FIG. 1, or with a corrugated configuration, as in the embodiment in FIG. 7. Actually, the blade forms an integral extension of the rear wall. As illustrated in FIG. 16, the blade normally occupies the dotted line configuration thereof when no article is inserted in the receptacle. However, when an article is inserted the blade is deflected at the area thereof immediately adjacent the article to the solid line position. However, because of the varying thickness of the blade, or its corrugated configuration, portions of the blade laterally adjacent to the article are not materially affected and remain available for holding other and different sized articles. With this form of the invention however, it will be appreciated that the rear wall of the article will have an opening 50 formed therein at least at the location of the spring member.

Another embodiment of the invention is illustrated in FIG. 9. This embodiment may be constructed in the same manner as the previously described embodiments, i.e., of a molded plastic construction having one or more spring members mounted thereon or integrally formed therewith. In this embodiment of the invention however article holder 30 is formed with two article holding sections **30*a*, 30*b*, each of which contains a spring element or spring block 36, of the type described above. In this form the section 30*a* is somewhat larger than the section 30*b*, so that it can accommodate relatively large articles, while section 30b accommodates smaller articles. In this regard, it is noted that if large articles are to be held in the holder of the present invention, in addition to making the holder larger, as with the section 30a in the right of FIG. 9, it is contemplated that spring members 36 may be placed along both the side walls 32, 33** of the holder, in order to increase the spring force applied to the article to hold it in the container.

It often occurs that certain types of articles, such as for example large marking pens and the like, are designed with mounting clasps that can accommodate only thin materials such as a shirt pocket or the like, and cannot be mounted on the relatively thick partition member formed in pockets in briefcases or other carrying bags. The article holder of the present invention is designed to accommodate such larger articles which cannot be secured to conventional partitions and which even may be too large to be inserted within the article holder of the invention. In this connection, end walls 34, 35 are formed, in the illustrative embodiment of the invention, to be generally concave so that the clasp 70 of such a large pen 72 or the like can be placed over the end wall of the receptacle. The concave outwardly opening configuration of the end walls of the receptacle serve to hold such articles against shifting thereon and form, in effect, a pocket retaining the article. The curvature of the side walls will accommodate a range of pens of different cross sectional dimensions. Another configuration for the concave end walls contemplated for the holder of the present invention is illustrated in FIG. 10A.

In another embodiment of the invention, illustrated in FIG. 10, the end walls of the holder can be concave and open inwardly, so that the angle between the wall and the partition 51, on which the holder is mounted, will serve to locate the outwardly mounted pen 72 and hold it against shifting away from partition 51.

As mentioned above, the article holder of the invention includes a pair of ledges 37, 38 integrally formed therein along its lower end. The ledges extend transversely of the article holder generally parallel to the spring member or members 36. The space between the ledges or stops serves to protect the tips of pencils and other similarly shaped items from damage. The stops are preferably continuous along the entire width of the article holder, although they can be formed intermittently if desired. The edges of these ledges may be sharp angled, as illustrated in FIG. 2, or they may be rounded and/or beveled to increase the wedging action thereof. Alternatively, these edges may even be serrated to further increase their gripping action on the tip of the pencil in order to aid the spring in resisting lateral movement of an article once it is placed in the holder.

As mentioned, the bottom wall 24 of the article holder may be opened, with an opening 54 formed between ledges 37, 38, to permit dust, dirt and other particles to fall out of the holder. Alternatively, if this is not desired, the holder can be provided with a closed bottom portion, or even with a removable cap 55, as illustrated in FIG. 15 of the drawing. This cap can simply be frictionally fit in the open end 24 of the holder as desired. Thus, the cap can be removed for cleaning of the holder, if necessary.

It is contemplated that the article holder of the present invention can be secured to any type of support structure as desired, in any convenient manner. However, in the preferred embodiment of the present invention a clasp 39 is utilized, as discussed above, in order to removably mount the article holder on the partition or pocket wall of a briefcase or bag, or even in a shirt or jacket pocket. The clasp is proportioned to allow easy installation, shifting, and removal by hand and yet has sufficient strength to maintain the holder attached to the support member without slippage during transportation.

In the embodiment of the clasp illustrated in FIG. 2 of the drawing the extreme free end or tip 56 of the clasp finger (which in this embodiment of the invention has a width substantially the same width as the rear wall 33 of the holder) is slightly curved outwardly away from the wall 33 in order to make insertion of the support member 51 between the clasp and the rear wall easier. However, this curved tip also may act as an entrapping obstacle to sheets of paper or the like held in the briefcase pocket. To avoid this it is preferable that the tip be flat and tapered towards rear wall 33 of the holder. With this configuration it may be difficult to spread the clasp in order to insert the support member. To overcome these problems, as seen in FIG. 17, a spreader member 58 is provided which constitutes an elongated bar, having a flat lower surface, and longer than the clasp finger itself, positioned in the space 58' formed between the clasp finger 39 and the rear wall 33 of the holder. The finger 39, being integrally formed with the rear wall, is spaced further away from the rear wall adjacent its upper end 76 than at its lower end or tip 57. The spreader bar is dimensioned such that its width is approximately the same as the width of the space 58' adjacent its top, so that the spreader bar can be stored in that space when not needed. However, when it is desired to insert the holder on a partition the spreader bar is grasped between the thumb and the index finger of one hand and slid downwardly in space 58' to push the tip 57 of the finger 39 away from the adjacent side wall, thereby to form a space therebetween. This space allows partition 51 to be inserted between tip 57 and the adjacent side wall. When the clasp is then pushed down against the partition 51 the spreader 58 will ride up along the top of the partition 51 back into the upper portion of the space 58' where it no longer has any effect on clasp 39. The end 57 of the clasp is then free to move inwardly against the partition and clamp the holder onto the partition member. While not illustrated, it is contemplated that the ends of the spreader bar 58 be shaped such that they are larger than the dimension of the slot 58' so that they cannot slide laterally out of the article holder when it is in its storage position.

While a single clasp arrangement has been illustrated in FIGS. 1 and 2 of the drawing, it is contemplated that the clasp may be formed as two or more individual clasps or fingers, as seen in FIG. 19, at 62, 63, or as more than two clasps distributed in any suitable way along any one of the side walls of the article.

Accordingly, it is seen that a relatively simply constructed article holder is provided which is adapted to hold individual articles such as pens, pencils and the like, in a relatively fixed position against movement when inserted into the holder. Because of the specialized construction of the spring elements used in the present invention there is no need for the user to select the location or size of a particular hole or position for the article he wishes to insert in the holder, as the springs will accommodate within the same holder articles of many different sizes. The holder is conveniently mounted on a partition in a briefcase, taking up little space therein, and it is designed to protect the tips of pens, or pencils or the like, within the briefcase against any damage.

Although illustrative embodiments of the present invention have been described herein with reference to the accompanying drawings, it is to be understood that the invention is not limited to those precise embodiments, but that various changes and modifications may be effected therein by one skilled in the art without departing from the scope or spirit of this invention.

What is claimed is:

1. An article holder comprising a substantially rigid receptacle having a pair of opposed rigid side walls and a pair of opposed rigid end walls defining therebetween an open upper end for the receptacle, a bottom end opposite said open upper end, spring means mounted within said rigid recepacle for biasing articles placed in said rigid receptacle, through said open end, towards one of said side walls while resisting movement of the article transversely of the direction of insertion thereof, said spring means comprising a resilient compressible block of elastic foam material mounted on one of said side walls and having upper and lower ends and a width dimension which slopingly increases from said upper end towards said lower end thereby to hold the article in a relatively fixed position in said receptacle; a flexible film overlying said width dimension of said foam material, means in said receptacle defining a continuous slot spaced above said bottom end thereof and below said lower end of said spring means for receiving the ends of articles inserted in the receptacle while limiting the depth of insertion of articles into said receptacle and holding the inserted ends of the articles above said bottom end of the receptacle; and means for securing said receptacle to a support.

2. An article holder as defined in claim 1 wherein said spring means has greater shear flexibility in the direction transverse to the direction of insertion of the article into the receptacle than in the direction of insertion of the article into the receptacle whereby the article is held in a relatively fixed position in the receptacle while the portions of the spring means adjacent thereto remain relatively undisturbed and available for receiving and holding another article without disturbing or interfering with articles previously placed in the receptacle.

3. An article holder as defined in claim 2 wherein said spring structure comprises an elongated blade member having upper and lower edges and being mounted on one of said receptacle walls adjacent its upper edge with its lower edge projecting away from said wall toward the other of said walls, against which said articles are biased.

4. An article holder as defined in claim 3 wherein said blade has a relatively smooth surface facing said other wall and a varying cross-sectional thickness at least adjacent its lower edge in the direction transverse to the direction of insertion of the articles into the receptacle.

5. An article holder as defined in claim 3 wherein said blade is corrugated at least adjacent its lower edge, with said corrugations extending in the direction of insertion of the articles into the receptacle.

6. An article holder as defined in claim 3 wherein said spring structure includes a resilient compression block positioned between said blade and said one wall of the receptacle, said block providing the spring force holding said article in said receptacle.

7. An article holder as defined in claim 2 wherein said block of elastic foam material has a generally wedge shaped cross-section mounted on said receptacle wall along one of its long legs with its short leg facing away from the open end of the receptacle, the other long leg of said block facing said other of the receptacle walls.

8. An article holder as defined in claim 2 wherein said spring structure comprises a plurality of closely spaced vertically extending resilient blades.

9. An article holder as defined in claim 8 wherein said blades are relatively flat and have a generally triangular configuration including a long base secured to said one wall.

10. An article holder as defined in claim 2 wherein said securing means comprises at least one integral resilient finger on said receptacle extending outside of the receptacle and closely adjacent to and inclined towards one of the walls thereof for grasping between the finger and the adjacent receptacle wall a thin flat support member on which the receptacle is to be supported, said finger including a free end biased towards the adjacent receptacle wall and an upper end integral with the receptacle wall including a curved portion bending away from said wall to define a tapering space between the wall and said finger.

11. An article holder comprising a substantially rigid receptacle having a pair of opposed side walls and at least one open end, spring means mounted within said receptacle for biasing articles placed in said receptacle, through said open end, towards one of said side walls while resisting transverse movement of the article with respect to the spring thereby to hold the article in a relatively fixed position in said receptacle; means in said receptacle spaced from the end thereof opposite said at least one open end and below said spring means for limiting the depth of insertion of articles into said receptacle; and means for securing said receptacle to a support; said spring means comprising a spring structure having greater shear flexibility in the direction transverse of the direction of insertion of the article into the receptacle than in the direction of insertion of the article into the receptacle whereby the article is held in a relatively fixed position in the receptacle while the portions of the spring structure adjacent thereto remain relatively undisturbed and available for receiving and holding another article without disturbing or interfering with articles previously placed in the receptacle; said securing means comprising at least one integral resilient finger on said receptacle extending outside of the receptacle and closely adjacent to and inclined towards one of the walls thereof for grasping between the finger and the adjacent receptacle wall a thin flat support member on which the receptacle is to be supported, said finger including a free end biased towards the adjacent receptacle wall and an upper end integral with the receptacle wall including a curved portion bending away from said wall to define a tapering space between the wall and said finger; and a spreader bar removably positioned in said space for movement to a position between said wall and said free end of the finger to move the finger away from the wall thereby to permit insertion of a support member between the free end of the finger and the wall whereby movement of the support member into said space moves said bar away from the free end of the finger permitting the finger to close on the support member.

12. An article holder as defined in claim 2 wherein said receptacle includes a pair of spaced end walls connecting said side walls.

13. An article holder as defined in claim 12 wherein said end walls are generally parallel to each other and are concave and open outwardly of the receptacle to define pockets for receiving a pen, pencil and the like.

14. An article holder as defined in claim 13 wherein said concave end walls are substantially symmetrical.

15. An article holder as defined in claim 2 wherein said means for limiting the depth of insertion of articles into said receptable comprises at least one straight continuous stop ledge on one of said receptacle walls extending transversely of the direction of insertion of the article.

16. An article holder as defined in claim 2 wherein said means for limiting the depth of insertion of articles into said receptacle comprises a pair of laterally spaced parallely extending straight continuous stop ledges on said receptacle walls adapted to receive therebetween the tip of a pencil inserted in said receptacle with the end of the pencil tip extending below the ledges and held thereby above the bottom end of the receptacle.

17. An article holder as defined in claim 2 wherein said spring means comprise a pair of said spring structures on said one wall of the receptacle in spaced parallel relation to each other.

18. An article holder as defined in claim 2 wherein said spring structure is integrally formed with one of said side walls of said receptacle.

19. An article holder as defined in claim 2 wherein said bottom end of said receptacle has an opening formed therein.

20. An article holder as defined in claim 19 including a removable closure mounted in said opening in said bottom end.

21. An article holder comprising a substantially rigid receptacle having a pair of opposed generally parallely extending rigid side walls and a pair of laterally spaced rigid end walls connecting said side walls, said receptacle having an upper open end and an opposed bottom end; spring means in said receptacle on one of said side walls for biasing articles placed in said receptacle, through said open end, toward the other of said side walls; said spring means having a greater degree of shear flexibility in the direction which is parallel to said side walls and transverse to the direction of insertion of the article than in the direction of insertion of the article, whereby the spring holds the article in a relatively fixed position against said other side wall and resists movement of the article in a transverse direction along the spring while the portions of the spring means adjacent to the article are relatively undisturbed and available for receiving and holding another article of different thickness without interfering with articles previously placed in the receptacle; said spring means comprising a resilient compressible block of elastic foam material and having upper and lower ends and a width dimension which increases from said upper end towards said lower end; a flexible film overlying said width dimension of said foam material means integrally formed on at least one of said side walls adjacent said lower end of the receptacle for defining a continuous slot and at least one stop ledge extending from said one wall into the receptacle parallel to said spring means for limiting the depth of insertion of articles into the receptacle and holding the inserted ends of the article above said bottom end of the receptacle; and means integral with at least one of said receptacle walls for removably securing said receptacle on a support member.

22. An article holder as defined in claim 21 wherein said securing means comprises at least one integral resilient finger on said receptacle extending outside of the receptacle and closely parallel to one of the walls thereof for grasping between the finger and the adjacent receptacle wall a thin flat support member on which the receptacle is to be supported.

23. An article holder comprising a substantially rigid receptacle having a pair of opposed generally parallely extending side walls and a pair of laterally spaced end walls connecting said side walls, said receptacle having an upper open end and an opposed bottom end; spring means in said receptacle on one of said side walls for biasing articles placed in said receptacle, through said open end, toward the other of said side walls; said spring means having a greater degree of shear flexibility in the direction which is parallel to said side walls and transverse to the direction of insertion of the article than in the direction of insertion of the article, whereby the spring holds the article in a relatively fixed position against said other side wall and resists movement of the article in a transverse direction along the spring while the portions of the spring means adjacent to the article are relatively undisturbed and available for receiving and holding another article without interfering with articles previously placed in the receptacle; means on at least one of said side walls adjacent said lower end of the receptacle for defining at least one stop ledge extending from said one wall into the receptacle parallel to said spring means for limiting the depth of insertion of articles into the receptacle; and means integral with at least one of said receptacle walls for removably securing said receptacle on a support member, said securing means comprises at least one integral resilient finger on said receptacle extending outside of the receptacle and closely parallel to one of the walls thereof for grasping between the finger and the adjacent receptacle wall a thin flat support member on which the receptacle is to be supported; said finger including a free end biased towards the adjacent receptacle wall and an upper end integral with the receptacle wall including a curved portion bending away from said wall to define a tapering space between the wall and said finger; and a spreader bar movably positioned in said space for movement to a position between said wall and said free end of the finger to move the finger away from the wall thereby to permit insertion of a support member between the free end of the finger and the wall whereby movement of the support member into said space moves said bar away from the free end of the finger permitting the finger to close on the support member.

24. An article holder as defined in claim 22 wherein said end walls are concave and open outwardly of the receptacle to define pockets for receiving a pen, pencil and the like.

25. An article holder as defined in claim 22 wherein said spring means is integrally formed with said receptacle.

26. An article holder as defined in claim 22 wherein said lower end of the receptacle has an opening formed therein.

27. An article holder as defined in claim 26 including a removable closure mounted in said opening at said lower end of the container.

28. An article holder as defined in claim 22 wherein said spring means comprises an elongated blade member mounted on one of said side walls and having a lower edge projecting away from said one side wall, said blade having a varying cross-sectional thickness at least adjcent its lower edge along areas extending parallel to the direction of insertion of articles into the receptacle.

29. An article holder as defined in claim 7 wherein said other leg of said block has a smooth abrasion resistant surface formed thereon.

30. An article holder as defined in claim 6 wherein said skin is corrugated in the direction of insertion of an article into the holder.

* * * * *